US005954202A

United States Patent [19]

Mellon

[11] Patent Number: 5,954,202

[45] Date of Patent: Sep. 21, 1999

[54] PAPERBOARD BLANK FOR A SELF-CONTAINED, RECLOSABLE PACKAGE

[75] Inventor: Mark Mellon, Bear, Del.

[73] Assignee: Westvaco Corporation, New York, N.Y.

[21] Appl. No.: 09/034,953

[22] Filed: Mar. 4, 1998

Related U.S. Application Data

[63] Continuation-in-part of application No. 08/672,554, Jun. 28, 1996, abandoned.

[51] Int. Cl.[6] ..... B65D 75/14

[52] U.S. Cl. ..... 206/462; 206/469; 206/532; 229/103.3

[58] Field of Search ..... 229/103.3; 206/462, 206/469, 532, 531

[56] References Cited

U.S. PATENT DOCUMENTS

| | | |
|---|---|---|
| 2,765,579 | 10/1956 | Gordon . |
| 2,993,590 | 7/1961 | Denton . |
| 3,062,366 | 11/1962 | Palmer . |
| 3,246,746 | 4/1966 | Holley . |
| 3,246,747 | 4/1966 | Blish . |
| 3,248,842 | 5/1966 | Peppler . |
| 3,556,388 | 1/1971 | Klein . |
| 3,559,799 | 2/1971 | Kramer . |
| 3,587,848 | 6/1971 | Froehlig . |
| 3,659,706 | 5/1972 | Serrell . |
| 3,743,084 | 7/1973 | Douglas . |
| 3,820,655 | 6/1974 | La Tourette et al. . |
| 4,120,399 | 10/1978 | Clarke . |
| 4,125,190 | 11/1978 | Davie, Jr. et al. . |
| 4,291,807 | 9/1981 | Giordano et al. . |
| 4,308,986 | 1/1982 | Parrilli . |
| 4,506,789 | 3/1985 | Dlugosz . |
| 5,088,603 | 2/1992 | Kirkpatrick . |
| 5,109,984 | 5/1992 | Romick . |
| 5,244,091 | 9/1993 | Tannenbaum . |
| 5,323,907 | 6/1994 | Kalvelage . |
| 5,447,230 | 9/1995 | Gerondale . |

FOREIGN PATENT DOCUMENTS 2266880 of 1993 United Kingdom .

OTHER PUBLICATIONS

"Fast Design Reference," Artios Corp., 40 Westover Road, Ludlow, MA 01056—Design Reference 10–22 Aug. 15, 1994.

*Primary Examiner*—Stephen P. Garbe
*Attorney, Agent, or Firm*—T. R. McDaniel; R. L. Schmalz

[57] ABSTRACT

This invention relates to paperboard blanks which are used to form self-contained, reclosable packages. Such structures of this type, generally, are comprised of one piece of paperboard that when folded acts as an outer package when sealed and an innovative reclosable package after being opened.

2 Claims, 5 Drawing Sheets

PAPERBOARD BLANK FOR A SELF-CONTAINED, RECLOSABLE PACKAGE

CROSS-REFERENCE TO RELATED APPLICATIONS

This application is a continuation-in-part of U.S. application Ser. No. 08/672,554, filed Jun. 28, 1996, now abandoned.

BACKGROUND OF THE INVENTION

1. Field of the Invention

This invention relates to paperboard blanks which are used to form self-contained, reclosable packages. Such structures of this type, generally, are comprised of one piece of paperboard that when folded acts as an outer package when sealed and an innovative reclosable package after being opened.

2. Description of the Related Art

It is known, in medication dispensing packages, to employ a reusable plastic dispenser for dispensing medication from a blister pack. Exemplary of such prior art is U.S. Pat. No. 5,109,984 ('984) to J. M. Romick, entitled "Unit-Dose Medication Handling and Dispensing System". While the '984 patent teaches the use of dispensing medication from a blister pack, the container is constructed of plastic and does not have the ability to contain different types of medications. This is problematic in that the end-user consumer may want to have different types of medications contained within the same package so that the consumer does not have to carry around several different packages. Also, the plastic container limits the types of graphics that can be placed upon the container and the plastic container is not easily recyclable. Therefore, a more advantageous package would be one that is constructed of paperboard and is capable of carrying several different types of medications.

It is also known, in pharmaceutical package constructions, to make use of a paperboard package having a blister pack. Exemplary of such prior art is U.S. Pat. No. 3,659,706 ('706) to J. J. Serrell, entitled "Pharmacal Package Construction". While the '706 patent teaches the use of a blister sheet attached to paperboard backing sheets, the construction of the '706 patent is such that the package may not remain closed. This is due to the fact that the construction of the '706 patent relies heavily upon the interfitting of the oppositely located blisters. Also, the medications in the '706 patent cannot easily be removed. Therefore, a still further advantageous package, then, would be presented if the package would stay closed and the medication could be easily removed.

It is apparent from the above that there exists a need in the art for a package which is constructed of paperboard, and which is capable of holding various kinds of medications and that the medications are easily removed but, at the same time is reclosable. It is the purpose of this invention to fulfill this and other needs in the art in a manner more apparent to the skilled artisan once given the following disclosure.

SUMMARY OF THE INVENTION

Generally speaking, this invention fulfills these needs by providing a paperboard blank for a self-contained, reclosable package, comprising a first paperboard panel hingedly connected to a second paperboard panel, a package fastener operatively attached to the first paperboard panel, a first perforation located through the second paperboard panel, a third paperboard panel hingedly connected to the second paperboard panel, a second perforation located through the third paperboard panel, a fourth paperboard panel hingedly connected to the third paperboard panel, a first aperture located through the fourth paperboard panel for overlying the second perforation, a fifth paperboard panel hingedly connected to the fourth paperboard panel, and a second aperture located through the fifth paperboard panel for overlying the first perforation.

In certain preferred embodiments, the fastener includes a tear strip or flap extensions. Finally, the blank also includes a reclosing means including a tab and a slot.

In another further preferred embodiment, one package is used to contain the medication(s) in that one piece of paperboard when folded acts as an outer package when sealed and an innovative reclosable package after being opened.

The preferred package, according to this invention, offers the following advantages: lightness in weight; ease of assembly; the ability to be self-contained; reclosability; improved graphics; improved recyclability; the ability to contain diverse products; ease of article removal; and good economy. In fact, in many of the preferred embodiments, these factors of self-containment, reclosability, print graphics, recyclability, containment of diverse articles, and ease of article removal are optimized to an extent that is considerably higher than heretofore achieved in prior, known paperboard packages.

The above and other features of the present invention, which will become more apparent as the description proceeds, are best understood by considering the following detailed description in conjunction with the accompanying drawings, wherein like characters represent like parts throughout the several views and in which:

A BRIEF DESCRIPTION OF THE DRAWINGS

DETAILED DESCRIPTION OF THE INVENTION

Figure 1:
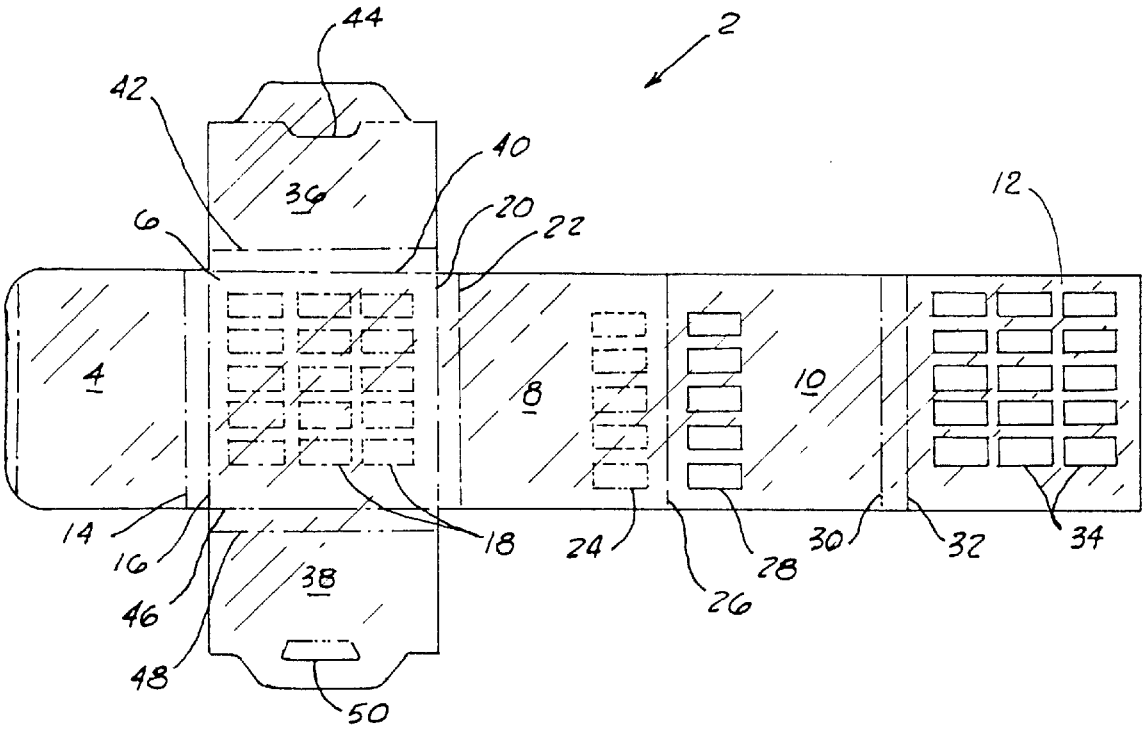
FIG. 1 is an illustration of a paperboard blank for a self-contained, reclosable package, according to the present invention.
Figure 5:
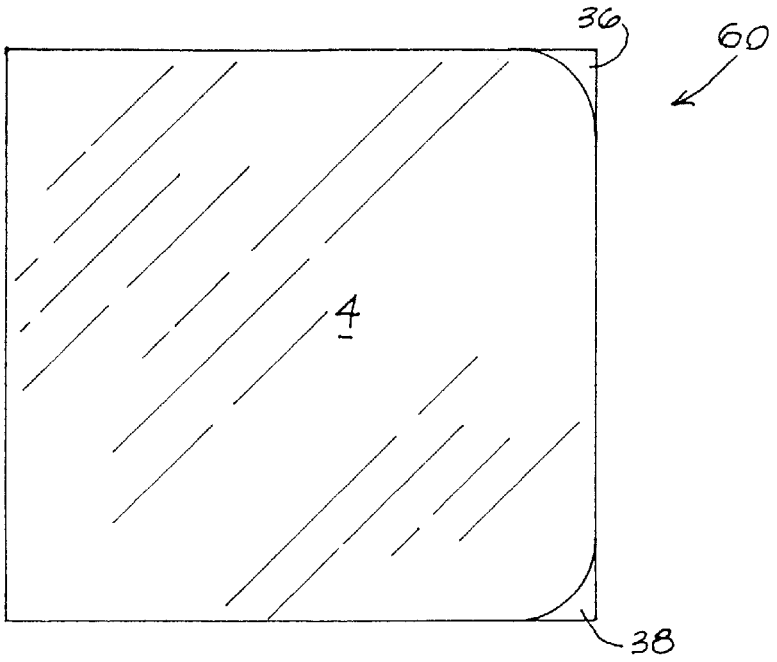
FIG. 5 is an illustration of a complete, self-contained, reclosable package, according to the present invention.

With reference first to FIG. 1, there is illustrated a paperboard blank 2 which is used for constructing a self-contained, reclosable package 60 (FIG. 5). In particular, blank 2 includes, in part, panels 4, 6, 8, 10, and 12, fold lines 14, 16, 20, 22, 26, 30, 32, 40, 42, 46, and 48, perforated areas 18 and 24, apertures 28 and 34, flaps 36 and 38, tab 44, and slot 50.

Blank 2, preferably, is paperboard constructed from a 0.018" thick solid bleached sulfate (SBS) sheet. Definitely, the term paperboard describes paper within the thickness range of 0.008 to 0.028". The invention is relative to the full scale of such a range as applied to packaging and beyond.

Fold lines 14, 16, 20, 22, 26, 30, 32, 40, 42, 46 and 48 are, preferably, formed by conventional techniques. Perforated areas 18 and 24 are, preferably, formed by conventional perforating techniques. Apertures 28 and 34 are, preferably, formed by conventional aperture making techniques. Finally, tab 44 and slot 50 are, preferably, formed by conventional techniques.

Figure 2:
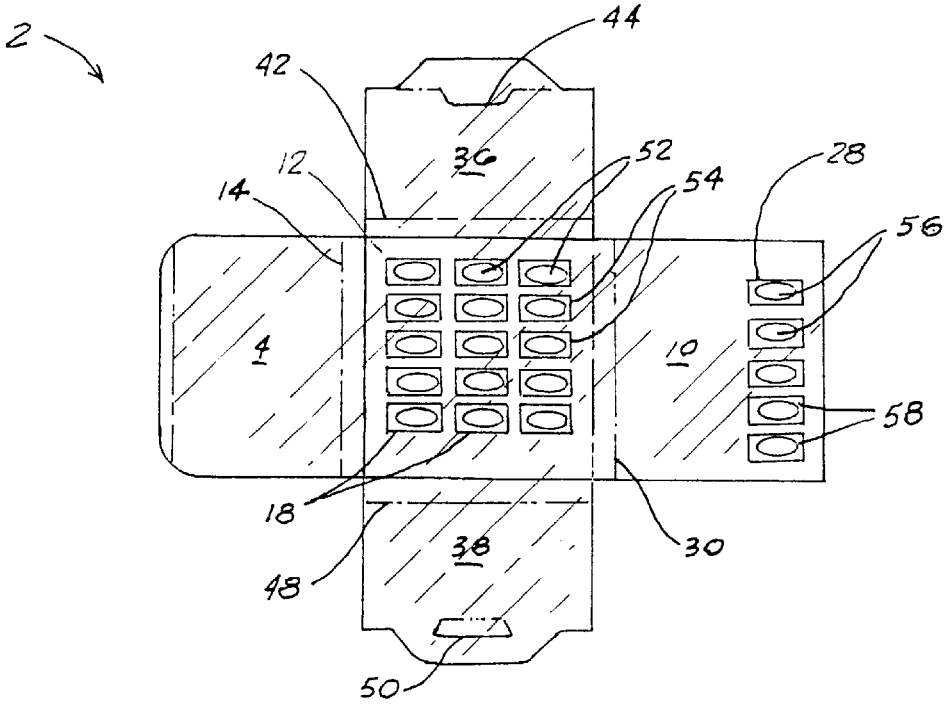
FIG. 2 is an illustration of the package with medication enclosed in a conventional blister pack and several panels folded, according to the present invention.

After blank 2 is formed according to FIG. 1, articles 52 and 56 are placed on panels 6 and 8, respectively, as shown in FIG. 2. Articles 52 and 56, preferably, are placed in conventional blister packs 54 and 58, respectively. It is to be understood that articles 52 and 56 can be different types of articles such as different types of medications.

After blister packs 54 and 58 are conventionally placed on panels 6 and 8, respectively, panels 12 and 10 are folded over and conventionally secured to panels 6 and 8, respectively as shown in FIG. 2. In this manner, panel 12 overlies blister packs 54 and panel 6 and panel 10 overlie blister packs 58 and panel 8. After panels 10 and 12 are folded over, blister packs 54 and 58, respectively, are sandwiched between panels 12 and 6 and 10 and 8, respectively, in order to keep blister packs 54 and 58 in place.

Figure 3:
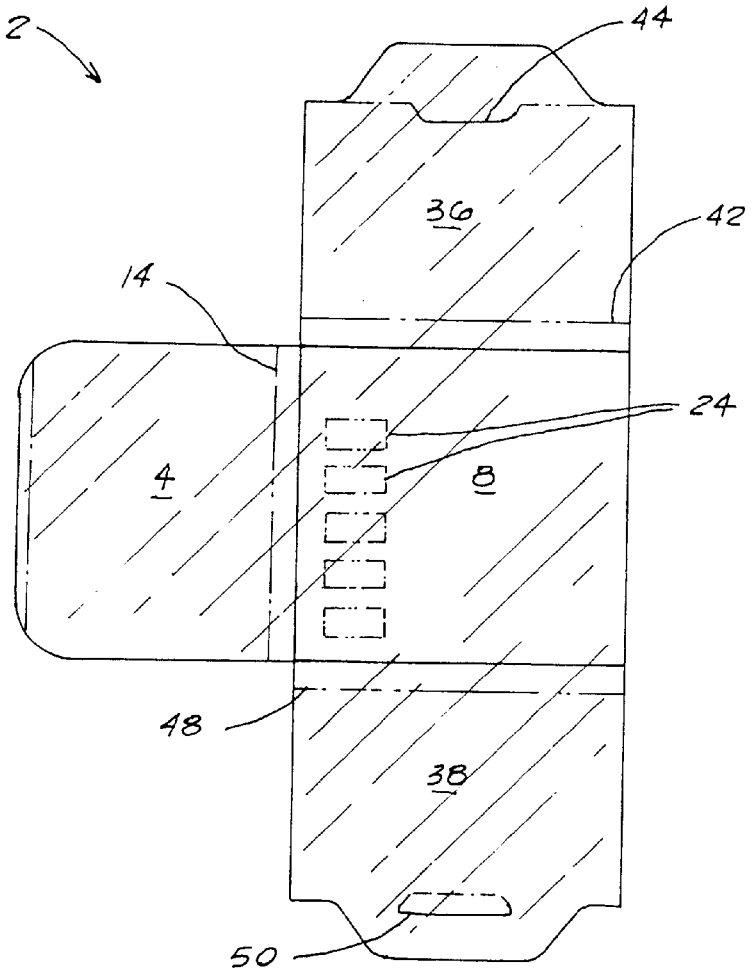
FIG. 3 is an illustration still more of the panels folded, according to the present invention.

With respect to FIG. 3, panels 10 and 8, which now sandwich articles 56, are folded over panels 6 and 12. In this manner articles 56 are now adjacent to articles 52.

Figure 4:
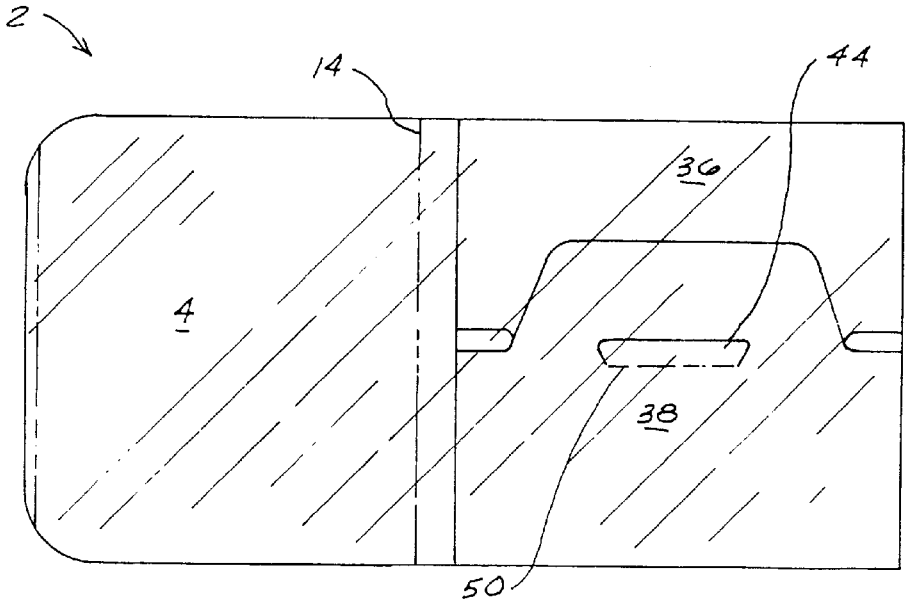
FIG. 4 is an illustration of the flaps of the package folded over the panels, according to the present invention.

As shown in FIG. 4, flaps 36 and 38 are folded over panel 8 such that panel 38 overlies panel 36 and tab 44 is inserted into slot 50. In this manner, articles 52 and 56 are retained in place and blank 2 can be reclosed after being opened by the end-user.

Finally, as shown in FIG. 5, panel 4 is folded over flaps 36 and 38 to complete the construction of a self-contained, reclosable package 60 for retaining articles.

Figure 6:
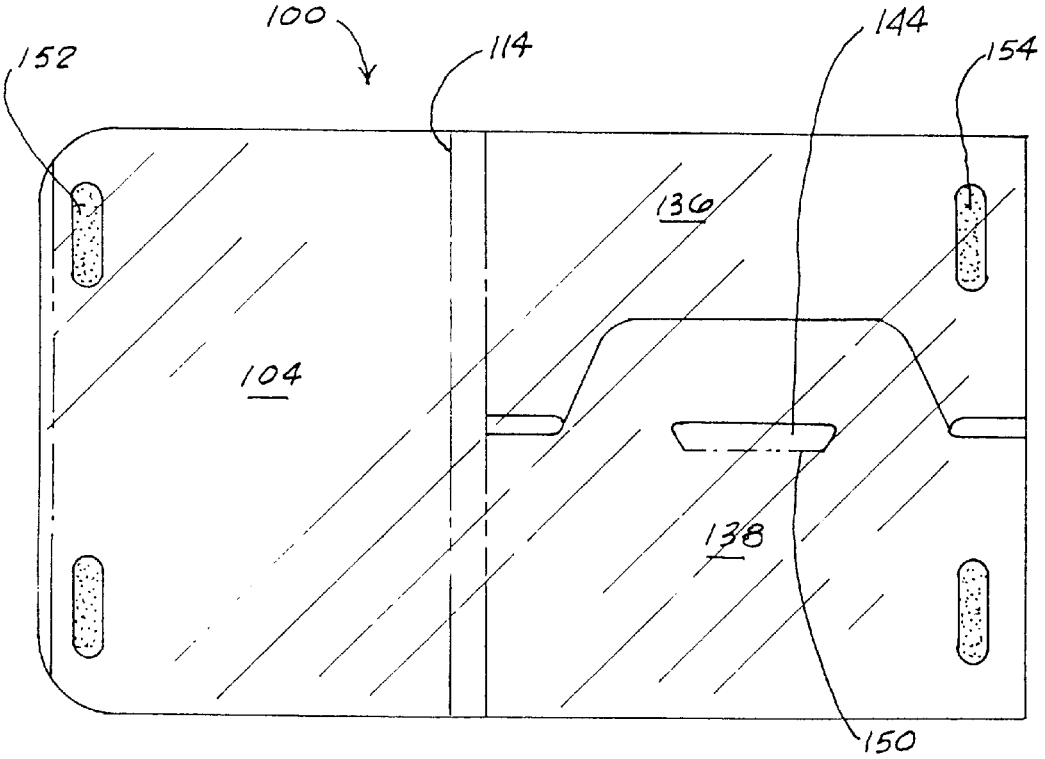
FIG. 6 is an illustration of a 50% release fastening means, according to the present invention.

FIG. 6 illustrates another embodiment of a self-contained, reclosable paperboard container 100. Container 100 is constructed substantially the same as container 60. In fact, the view of container 100 in FIG. 6 is very similar to the view of blank 2 in FIG. 4. For example, panel 104 in FIG. 6 corresponds with panel 4 in FIG. 4 and flap 138 in FIG. 6 corresponds with flap 38 in FIG. 4. Panel 104 can be conventionally secured to flaps 130 and 138.

Figure 7:
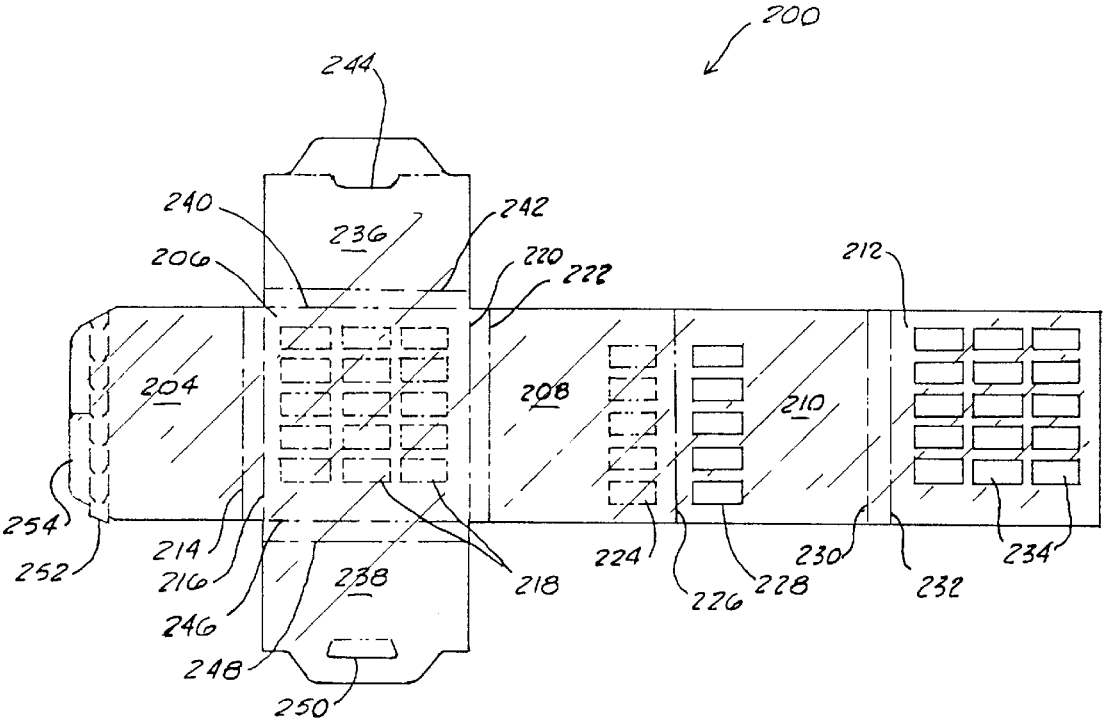
FIG. 7 is an illustration of another embodiment of a paperboard blank for a self-contained, reclosable package having a tear strip, according to the present invention.

FIG. 7 illustrates another embodiment of a paperboard blank 200 which is used to construct a self-contained, reclosable container. As can be seen in FIG. 7, blank 200 includes all of the same features of blank 2 (FIG. 1) except for tear strip 252 and flap 254. For example, panel 4 in FIG. 2 corresponds with panel 204 in FIG. 7 and fold line 32 in FIG. 1 corresponds with fold line 232 in FIG. 7.

Blank 200 is folded in the similar fashion as blank 2 in order to form a self-contained, reclosable container. The only difference being that tear-strip extension 254 is conventionally secured to flaps 236 and 238.

After extension 254 is secured to panels 236 and 238, the end-user merely has to pull on tear strip 252 in order to release panel 204 from flaps 236 and 238. After panel 204 is released, the end-user can get to the articles according to well known techniques.

Figure 8:
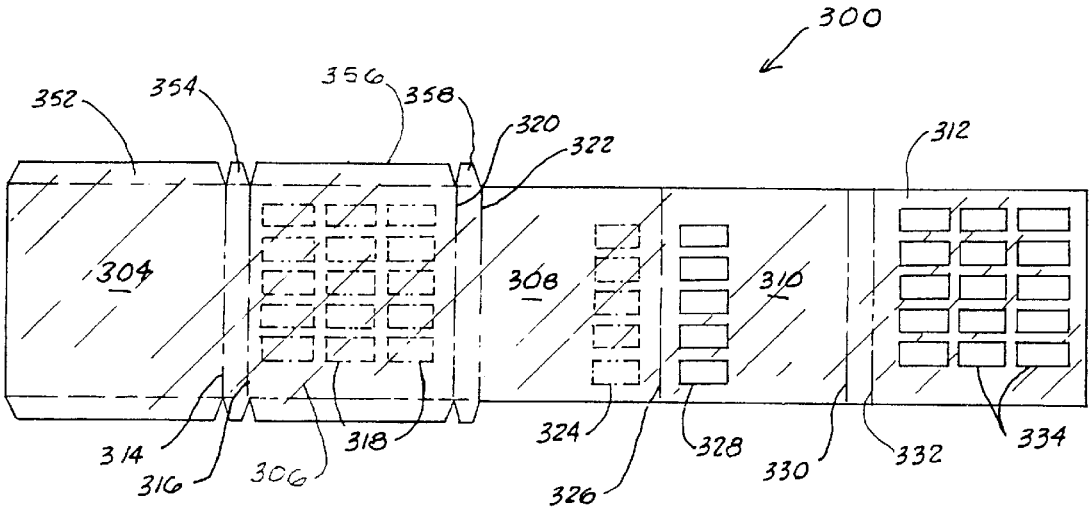
FIG. 8 is an illustration of another embodiment of a paperboard blank for a self-contained, reclosable package having seal ends, according to the present invention.

FIG. 8 shows still another embodiment of a paperboard blank 300 for a self-contained, reclosable seal end container. Blank 300 includes many of the elements of blank 2 (FIG. 1) except blank 300 lacks panels 36, 38, fold lines 40, 42, 46 and 48, tab 44 and slot 50. For example, perforated area 318 in FIG. 8 corresponds with perforated area 18 in FIG. 1 and aperture 328 in FIG. 8 correspond with aperture 28 in FIG. 1. However, blank 300 further includes panel extensions 352, 354, 356 and 358, which are formed on blank 300 according to conventional techniques.

During the construction of a self-contained, reclosable container using blank 300, panels 310 and 312 are folded over panels 306 and 308, respectively, as similarly shown with respect to panels 6, 8, 10 and 12 in FIG. 2. Afterwards, panel 308 is folded over panel 310, as similarly shown with respect to panels 8 and 10 in FIG. 3. Panel 304 is folded over panel 308 as generally shown in FIG. 5. Finally, extensions 352, 354, 356, and 358 are folded over the ends of the respective panels that they are attached to, according to conventional techniques. Flaps 352, 354, 356, and 358 are then folded toward each other so that they enclose and form ends of a self-contained, reclosable container (not shown).

It is to be understood that various mechanisms can be used in order to seal flap 304 to flap 308. A tear strip as shown in FIG. 7 could be used. However, other such mechanisms may be used.

Figure 9:
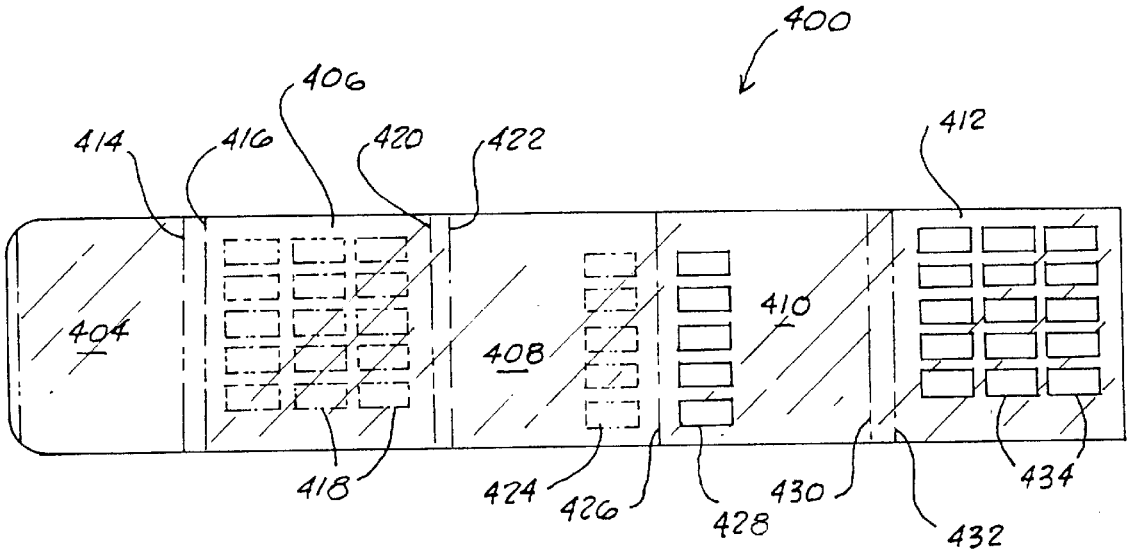
FIG. 9 is an illustration of another embodiment of a paperboard blank for a self-contained, reclosable sleeve package, according to the present invention.

Finally, there is illustrated another embodiment of a paperboard blank 400 for a self-contained, reclosable sleeve container. Blank 400 is similar to blank 300 (FIG. 8) except that blank 400 does not include flaps 352, 354, 356, and 358. For example, panel 404 in FIG. 9 corresponds with panel 304 in FIG. 8 and fold line 426 in FIG. 9 corresponds with fold line 326 in FIG. 8. Also, blank 400 is formed into a self-contained, reclosable container in a similar fashion in which blank 300 is formed into such a container, as previously discussed. However, the final steps of folding over flaps 352, 354, 356, and 358 are not needed for blank 400.

Once given the above disclosure, many other features, modifications or improvements will become apparent to the skilled artisan. Such features, modifications or improvements are therefore, considered to be a part of this invention, the scope of which is to be determined by the following claims.

What is claimed is:

1. A paperboard blank for a self-contained, reclosable package, wherein said blank is comprised of:

a first paperboard panel hingedly connected to a second paperboard panel;

a first perforation located through said second paperboard panel including a blister pack located substantially over said first perforation;

a third paperboard panel hingedly connected to said second paperboard panel;

a second perforation located through said third paperboard panel including a blister pack located substantially over said second perforation;

a fourth paperboard panel hingedly connected to said third paperboard panel;

a first aperture located through said fourth paperboard panel for overlying said second perforation;

a fifth paperboard panel hingedly connected to said fourth paperboard panel; and a second aperture located through said fifth panel for overlying said first perforation.

2. A method of constructing a self-contained, reclosable package from a paperboard blank having a first paperboard panel hingedly connected to a second paperboard panel, a first perforation located through said second paperboard panel, a third paperboard panel hingedly connected to said second paperboard panel, a second perforation located through said third paperboard panel, a fourth paperboard panel hingedly connected to said third paperboard panel, a first aperture located through said fourth paperboard panel, a fifth paperboard panel hingedly connected to said fourth paperboard panel, and a second aperture located through said fifth paperboard panel, wherein said method is comprised of the steps of:

placing a first blister pack substantially over said first perforation;

placing a second blister pack substantially over said second perforation;

folding said blank such that said fourth paperboard panel overlies said third paperboard panel and said second blister pack and said fifth paperboard panel overlies said second paperboard panel and said first blister pack;

folding said blank such that said third and fourth paperboard panels overlie said second and fifth paperboard panels such that said first and second blister packs substantially abut each other; and folding said fastener such that said fastener overlies said second paperboard panel, said third paperboard panel, said fourth paperboard panel, and said fifth paperboard panel to form a self-contained, reclosable package.

* * * * *